US009618194B2

(12) United States Patent
Tress et al.

(10) Patent No.: US 9,618,194 B2
(45) Date of Patent: Apr. 11, 2017

(54) LED LIGHTING SYSTEM

(71) Applicant: Rev-A-Shelf Company, LLC, Jeffersontown, KY (US)

(72) Inventors: Christopher M Tress, Louisville, KY (US); David Joseph Kleine-Kracht, Louisville, KY (US); Stephen A. Warden, Louisville, KY (US)

(73) Assignee: Rev-A-Shelf Company, LLC, Louisville, KY (US)

( * ) Notice: Subject to any disclaimer, the term of this patent is extended or adjusted under 35 U.S.C. 154(b) by 84 days.

(21) Appl. No.: 14/597,005

(22) Filed: Jan. 14, 2015

(65) Prior Publication Data

US 2016/0053973 A1 Feb. 25, 2016

Related U.S. Application Data

(60) Provisional application No. 62/039,748, filed on Aug. 20, 2014.

(51) Int. Cl.

| | |
|---|---|
| ***H01R 4/48*** | (2006.01) |
| ***F21V 23/00*** | (2015.01) |
| ***F21S 4/28*** | (2016.01) |
| *F21V 23/06* | (2006.01) |
| *F21V 17/10* | (2006.01) |
| *H01R 13/26* | (2006.01) |

(Continued)

(52) U.S. Cl.

CPC ..... *F21V 23/006* (2013.01); *F21S 4/28* (2016.01); *F21V 17/105* (2013.01); *F21V 23/06* (2013.01); *F21Y 2103/10* (2016.08); *F21Y 2115/10* (2016.08); *H01R 13/2442* (2013.01); *H01R 13/26* (2013.01); *H01R 13/432* (2013.01)

(58) Field of Classification Search

USPC ..... 439/862

See application file for complete search history.

(56) References Cited

U.S. PATENT DOCUMENTS 3,697,926 A * 10/1972 Krafthefer ..... H01R 12/515 439/629
6,350,143 B2 * 2/2002 Kato ..... 439/297

(Continued)

FOREIGN PATENT DOCUMENTS

| | | |
|---|---|---|
| DE | 10 2011 014 331 A1 | 3/2013 |
| DE | 10 2011 011 105 A1 | 8/2013 |
| PL | 390773 | 3/2010 |

OTHER PUBLICATIONS

Kluś ©, LED Extrusions, 2006, pp. 1-192.

Outwater Plastics Industries Inc. © & Architectural Products Catalog, dated 2013, pp. 647-742.

*Primary Examiner* — Tho D Ta

(74) *Attorney, Agent, or Firm* — Brinks Gilson & Lione

(57) ABSTRACT

A lighting system including an extrusion, a lighted strip, a control board, and a connector. The extrusion comprises a pair of side walls coupled by a connecting member, where the connecting member forms a first shelf for a lighted strip and a pair of flanges projecting from the side walls form a second shelf for a control board. The connector comprises a shell with an outer surface which is adapted to be coupled with the extrusion, and a pin which can be adapted to receive a wire adjacent a first end of the connector. The pin also including a curved contact plate which can be adapted to receive the lighted strip adjacent a second end of the connector.

17 Claims, 11 Drawing Sheets

(51) Int. Cl.

| | |
|---|---|
| *H01R 13/432* | (2006.01) |
| *H01R 13/24* | (2006.01) |
| *F21Y 103/10* | (2016.01) |
| *F21Y 115/10* | (2016.01) |

(56) References Cited

U.S. PATENT DOCUMENTS

| | | | | |
|---|---|---|---|---|
| 6,609,810 | B2 * | 8/2003 | Kim | F41G 1/35 200/553 |
| 6,932,495 | B2 | 8/2005 | Sloan et al. | |
| 7,044,809 | B2 * | 5/2006 | Kuroda | H01R 43/16 439/660 |
| D621,542 | S | 8/2010 | Kluś | |
| 7,766,502 | B2 | 8/2010 | Tress | |
| D625,463 | S | 10/2010 | Kluś | |
| 7,954,973 | B1 | 6/2011 | Holland et al. | |
| 7,954,979 | B2 | 6/2011 | Sommers et al. | |
| D662,255 | S | 6/2012 | Kluś | |
| D662,256 | S | 6/2012 | Kluś | |
| 8,262,250 | B2 | 9/2012 | Li et al. | |
| 8,267,540 | B2 | 9/2012 | Kluś | |
| 8,297,788 | B2 | 10/2012 | Bishop | |
| D693,051 | S | 11/2013 | Kluś | |
| D693,052 | S | 11/2013 | Kluś | |
| D695,953 | S | 12/2013 | Kluś | |
| D695,955 | S | 12/2013 | Kluś | |
| D698,075 | S | 1/2014 | Kluś | |
| D698,076 | S | 1/2014 | Kluś | |
| 8,628,212 | B2 | 1/2014 | Kluś | |
| D702,875 | S | 4/2014 | Kluś | |
| D705,982 | S | 5/2014 | Kluś | |
| D705,983 | S | 5/2014 | Kluś | |
| D705,984 | S | 5/2014 | Kluś | |
| 8,714,772 | B1 | 5/2014 | Levante et al. | |
| 8,894,428 | B2 * | 11/2014 | Cecchinelli | F16L 25/01 439/191 |
| 9,207,389 | B2 | 12/2015 | Moon et al. | |
| 2005/0270774 | A1 | 12/2005 | Pan | |
| 2009/0073692 | A1 | 3/2009 | Berger et al. | |
| 2011/0075413 | A1 | 3/2011 | Smith et al. | |
| 2011/0110077 | A1 | 5/2011 | Kluś | |
| 2011/0164419 | A1 | 7/2011 | Kluś | |
| 2014/0313774 | A1 | 10/2014 | Myers et al. | |
| 2016/0138768 | A1 * | 5/2016 | Greene | H05K 1/00 362/249.04 |

* cited by examiner

LED LIGHTING SYSTEM

CROSS-REFERENCE TO RELATED APPLICATIONS

The present disclosure is related to and claims all benefit pursuant to 35 U.S.C. §119 of U.S. Provisional Application Ser. No. 62/039,748, filed Aug. 20, 2014, which is incorporated by reference in its entirety.

FIELD

The present disclosure relates generally to lighting fixtures and systems, and more particularly to LED lighting systems.

BACKGROUND

The statements in this section merely provide background information related to the present disclosure and may not constitute prior art.

The use of LEDs and light strips are frequently used in lighting systems. However, light systems frequently need to be mounted on variety of surfaces, at a variety of angles, and directed to provide lighting to a variety of areas. Furthermore, lighting systems often have difficulty integrating both LED strips and control systems within small lighting systems used in confined spaces. Additionally, electrical adapters are frequently used for lighting systems. However, prior art electrical adapters are often complicated and difficult to manufacture, involving several different parts to electrically adapt LED strips to normal electrical wires.

SUMMARY

Further areas of applicability will become apparent from the description provided herein. It should be understood that the description and specific examples are intended for purposes of illustration only and are not intended to limit the scope of the present disclosure.

In one embodiment of the present disclosure, a lighting system is provided including an extrusion, a lighted strip, a control board, and a connector. The extrusion includes a pair of side walls coupled by a connecting member, where the connecting member defines a first shelf for a lighted strip. A pair of flanges project from the side walls forming a second shelf for a control board. The connector includes a shell and a pin arranged within an opening within the shell. The shell includes an outer surface which is configured to be coupled with the extrusion and an inner surface which defines the opening. The pin includes a contact plate arranged adjacent to a second end of the shell to receive the lighted strip. The pin is also adapted to receive a wire through a first end of the shell.

In another embodiment of the present disclosure, a lighting system is provided including an extrusion, a lighted strip, and a connector. The connector includes a shell having an outer surface with slats projecting outward and adapted to be inserted into the extrusion. The connector also includes an inner surface which defines an opening extending from a first end of the shell to a second end of the shell. The inner surface also includes a first ridge and a second ridge. The connector further includes a plurality of pins within the opening. Each pin is adapted to receive a wire through the first end of the shell, and each pin includes a curved contact plate which is adapted to contact a lighted strip adjacent to the second end of the shell. Each pin also includes a foot which rests against the second ridge of the inner surface, and a stop which rests against the first ridge of the inner surface.

DRAWINGS

In order that the disclosure may be well understood, there will now be described various forms thereof, given by way of example, reference being made to the accompanying drawings, in which.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
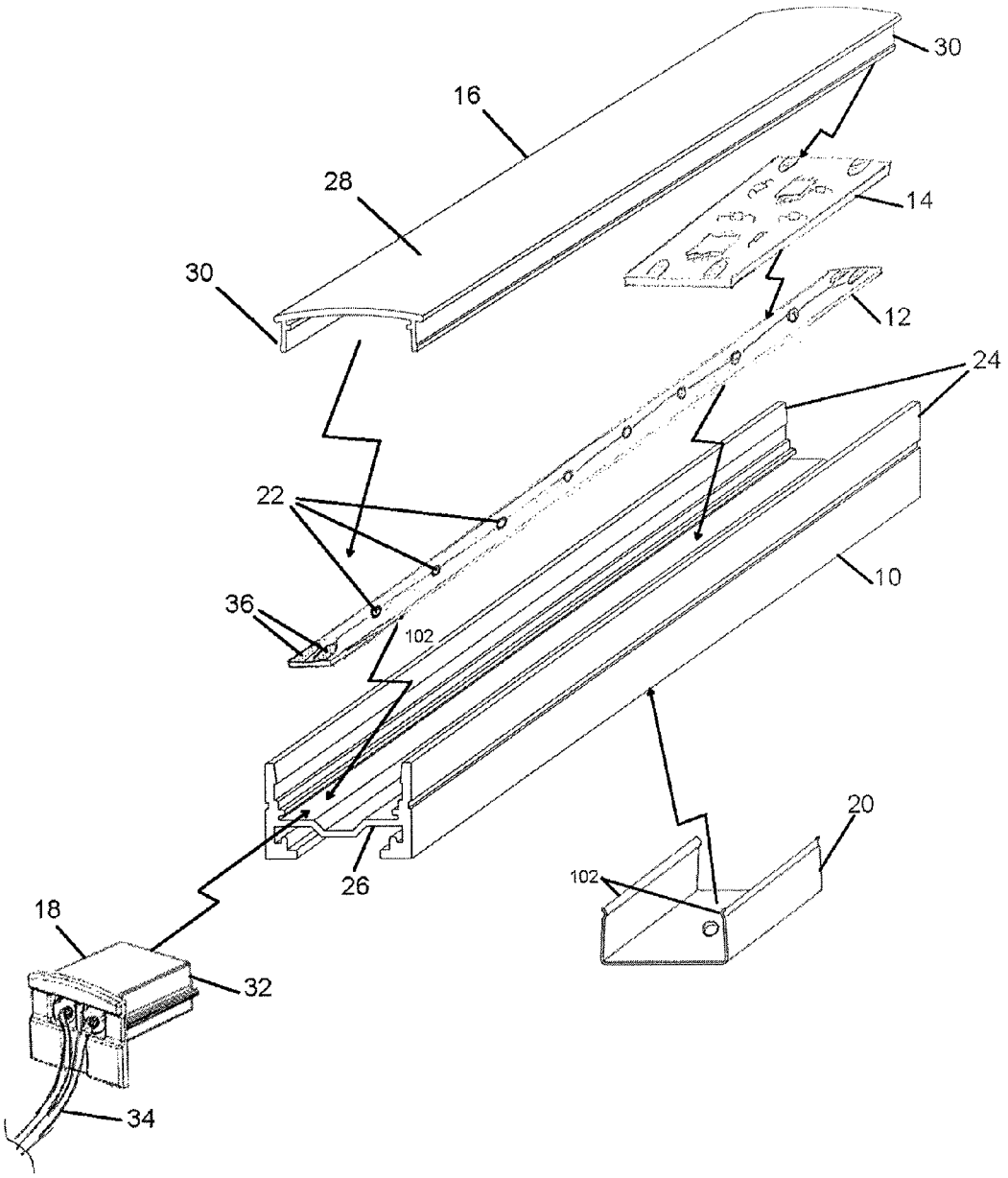
FIG. 1 is an exploded view of an example of a lighting system, showing an extrusion, a lighted strip, a control board, a diffuser, a bracket, and a connector.

Referring to FIG. 1, a lighting system is shown comprising an extrusion 10, a diffuser 16, a lighted strip 12 of LEDs 22, and a connector 18. The assembled lighting system may be mounted to a wall or other mounting surface with a mounting bracket 20 which may be coupled to the extrusion 10. Additionally, a control board 14 may be included within the extrusion 10 to control the lighted strip 12.

The extrusion 10 is formed of metal, plastic, or some other rigid material, and comprises a pair of side walls 24 coupled by a connecting member 26. In the embodiment shown, the extrusion 10 is a unitary structure having a uniform profile which extends a length from a first end to a second end, which may vary depending on the length of the lighting system needed. In another example, the extrusion may be multiple pieces that are welded, glued, or otherwise fixedly coupled to form the extrusion 10. The connector 18 may be plastic, nylon or some other rigid material that may be at least partially inserted into at least one of first or second ends of the extrusion 10. The connector 18 comprises a shell 32 which is adapted to be coupled with an end of the extrusion 10, and secured by friction fit. The connector 18 also couples electrical contacts 36 on the lighted strip 12 to an electrical source via a pair of wires 34 extending from a first end of the connector 18. The extrusion 10 may be covered by the diffuser 16 which has a pair of arms 30 coupled to a translucent member 28. The diffuser 16 may be made of metal, plastic or some other rigid material, or a combination of materials. Further, the translucent member 28, may be made of transparent or translucent materials and surrounded by similar material or some other rigid material. The translucent member 28 allows the light from the LEDs 22 to be more evenly spread on the area for which the lighting system is being used to illuminate. The lighted strip 12 comprises a length of circuit-bearing material such as silicon or a polymer. The lighted strip 12 may include a plurality of LEDs 22 arranged on a first surface of the lighted strip 12, and may include a layer of adhesive material on a second surface of the lighted strip 12.

Figure 2:
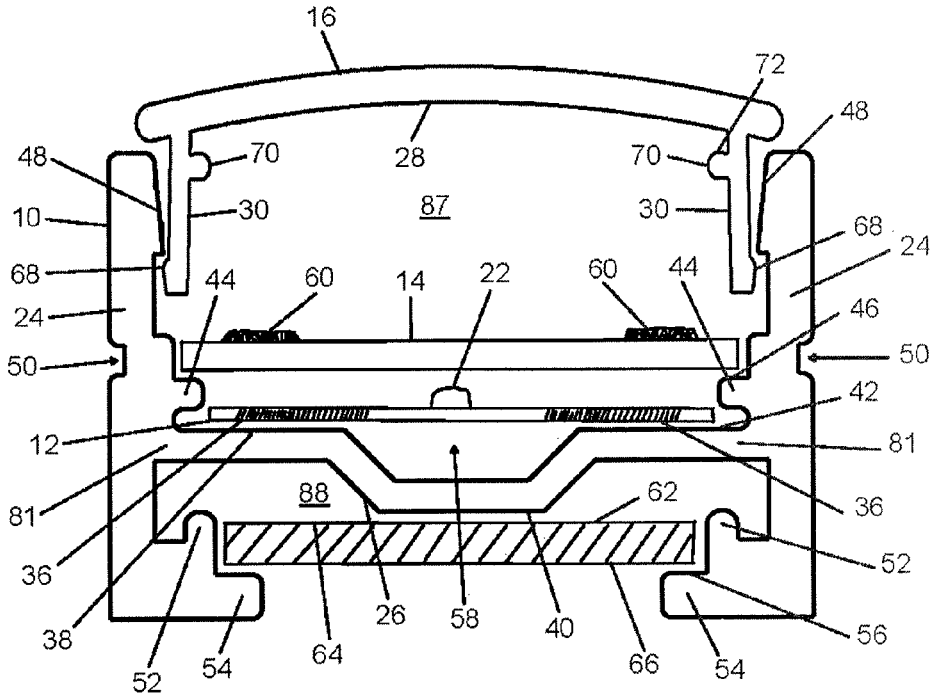
FIG. 2 is a side plan view of a part of a lighting system showing an extrusion, a lighted strip, a control board, a diffuser, and a magnetic block.

Referring to FIG. 2, an assembled embodiment of a portion of the lighting system is shown. The extrusion 10 comprises a pair of side walls 24 coupled by a connecting member 26. In the embodiment shown, the connecting member 26 is coupled to the side walls 24 at a joint 81 which is locating at an intermediate point on the pair of side walls 24, so that a portion of each of the pair of side walls 24 projects outward from both sides of the connecting member 26. In the embodiment shown, the connecting member 26 along with the portions of the pair of side walls 24 projecting in a first direction from the connecting member 26, define a first cavity 87. Similarly, the connecting member 26, along with the portions of the pair of side walls 24 projecting in a second direction from the connecting member 26, define a second cavity 88.

The connecting member 26 has a first surface 38 which faces the first cavity 87. At least a portion of the first surface 38 forms a first shelf 42. The first shelf 42 may be adapted to receive a lighted strip 12 which may be inserted into the first cavity 87. The lighted strip 12 may be coupled to the first shelf 42 by an adhesive placed on a surface of the lighted strip 12 contacting the first shelf 42.

The pair of side walls 24 may include a pair of flanges 44 protruding into either the first cavity 87 or the second cavity 88. These flanges 44 may extend along the entire length of the extrusion 10 or along only one or more portions of the extrusion 10. In the embodiment shown, the pair of flanges 44 are arranged on the pair of side walls 24 to extend outwardly from a respective side wall 24 toward the oppositely positioned side wall 24 at a position on the respective side walls 24 that creates a gap between the first shelf 42 and the flanges 44. The pair of flanges 44 together form a second shelf 46 which may be adapted to receive a control board 14. The control board 14 may be coupled to the second shelf 46 by an adhesive, or may be held in place by supports or electrical wires (not shown) connecting the control board 14, or the electrical contacts 60 thereof, to the lighted strip 12. The control board 14, when coupled directly or indirectly with the lighted strip 12, may be used to control the operation of the lighted strip, including switching the LEDs 22 on or off, or dimming the LEDs 22 as needed or in response to an input.

A pair of interlock members 48 may be formed toward the ends of the portions of the pair of side walls 24 which form the first cavity 87. In the embodiment shown, the interlock members 48 take the form of wedges which protrude into the first cavity 87. In other examples, the interlock members 48 may be any other form of protrusion. These wedges interact with receiving members 68 on the pair of arms 30 of the diffuser 16, such as by snap fit, to couple the diffuser 30 to the extrusion 10.

A pair of mounting projections 54 may be formed at or near the ends of the portions of the pair of side walls 24 which form the second cavity 88. In the embodiment shown, the mounting projections 54 protrude into the second cavity 88 and form a mounting shelf 56 along with a pair of protrusions 52 that extend toward the connecting member 26. At least one purpose of the mounting projections 54 is to define a space within the second cavity 88 in which a protrusion 134 (FIG. 6D) an embodiment of from a connector 16 may be inserted and secured by friction fit.

The extrusion 10 shown in FIG. 2 provides mounting features for at least three possible example methods of mounting the lighting system to a mounting surface. For a first method of mounting the lighting system, the connecting member 26 shown may include a depressed portion to define a mounting groove 58 in the first surface 38 of the connecting member 26. A mounting member or fastener such as a screw or a staple (not shown) may be inserted into the mounting groove 58, through the connecting member 26, to fixedly mount the lighting system to a mounting surface, such as a shelf, wall, or ceiling. After the mounting member has been set, the mounting groove 58 will ensure that any projection of the mounting member, such as a head of the fastener, above the first surface 38 will be separated, or spaced away from the first shelf 42, ensuring that the lighting strip 12 may be placed flatly on the first shelf 42, spanning the length mounting groove 58 without interference from any fastener present in the mounting groove 58.

A second example method of mounting the lighting system, it may be desirable to mount the lighting system using a pair of attractive magnets. A first magnet 62 may be secured within the extrusion 10 while a second magnet (not shown) may be placed on or behind the mounting surface. In the embodiment shown, the first magnet 62 may be inserted into the second cavity 88, such as by insertion, from the first or second ends of the extrusion 10. The magnet's 62 first surface 64 can contact a second surface 40 of the connecting member 26 which faces the second cavity 88. The mounting shelf 56 can contact the magnet's 62 second surface 66, and the pair of vertical protrusions 52 can restrict the horizontal movement of the magnet 62. In other example embodiments, glue, fasteners, a magnetically attractive extrusion 10, or any other mechanism may be used to maintain the magnet 62 within the second cavity 88. The magnet 62 may extend the entire length or a significant length of the extrusion 10, or there may be one or more separate magnets 62 positioned along the length of the extrusion 10.

The first magnet 62 may be held in place within the channel formed by the second cavity 88 by a smaller positioning magnet (not shown) placed within the mounting groove 58. The positioning magnet should be sized so that when resting in the mounting groove 58, the upper surface of the positioning magnet lies below the first shelf 42 so that it does not interfere with the placement of the lighting strip 12. The positioning magnet may be fixed within the channel formed by the mounting groove 58, by means of tape (not shown) on the first shelf 42 which covers at least a portion of the mounting groove 58. The lower surface of the tape contacts the positioning magnet to fix it in place within mounting groove 58. If the tape is double-sided, the upper surface of the tape may also be used to affix the lighting strip 12 to the first shelf 42.

A third example method of mounting the lighting system, may include a bracket 20. The bracket 20 may be fixedly coupled with the extrusion 10 to secure the lighting system to a mounting surface. In the embodiment shown in FIG. 2, to accommodate a bracket 20, the extrusion 10 has a pair of slots 50 on the surface of the side walls 24 by which gripping elements 102 (FIGS. 4A and 4B) of the bracket 20 may be received. The pair of slots 50 are arranged on opposite sides of the pair of side walls 24 from the connecting member 26 such that the bracket 20 can be formed to extend across the entire width of the extrusion 10 to secure the lighting system.

The lighting system shown in FIG. 2 includes a diffuser 16 which may be removeably coupled to the extrusion 10. This diffuser 16 comprises a translucent member 28 with a pair of arms 30 projecting into first cavity 87 of the extrusion 10. The pair of arms 30 may have receiving members 68 which project toward the side walls 24 of the extrusion 10 and interact with interlock members 48 of the extrusion 10 to secure the diffuser 16 to the extrusion 10. The translucent member 28 is able to transmit light from the LEDs 22 to the surface outside the lighting system. It may be desirable that the diffuser 16 is removeably coupled to the extrusion 10 such that the diffuser 16 may be easily removed to replace the lighted strip 12 or otherwise inspect or manipulate the first cavity 87 of the extrusion 10.

The diffuser 16 may also include a pair of film projections 70 extending from the arms 30 into the first cavity 87 of the extrusion 10. These film projections 70 together form a film shelf 72, on which a diffusing film (not shown) may be slidably inserted adjacent to the translucent member 26. This diffusing film may be desirable to better spread the light from the LEDs 22 so that it is more difficult to distinguish individual LEDs 22 from the lighting system as a whole. Additionally, the diffusing film may be used to tint or color the light coming from the LEDs 22 of the lighted strip 12. The diffusing film may be readily replaced by decoupling the diffuser 16 and the extrusion 10.

Figure 3A:
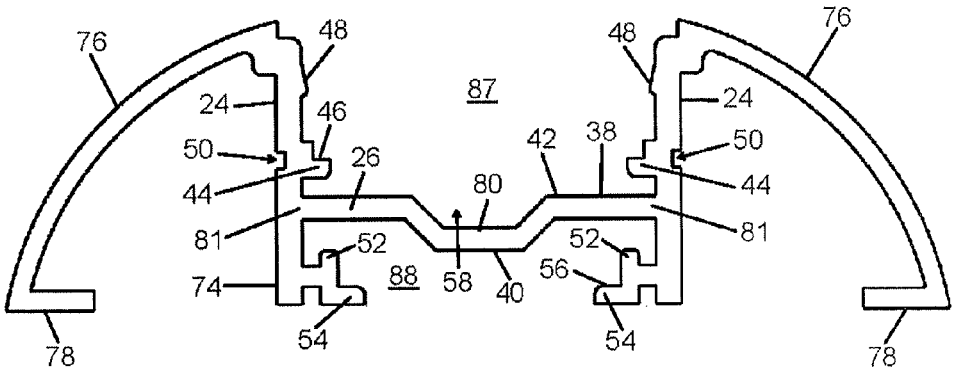
FIGS. 3A-3C are side plan views of extrusions, showing three possible examples of embodiments thereof.
Figure 3B:
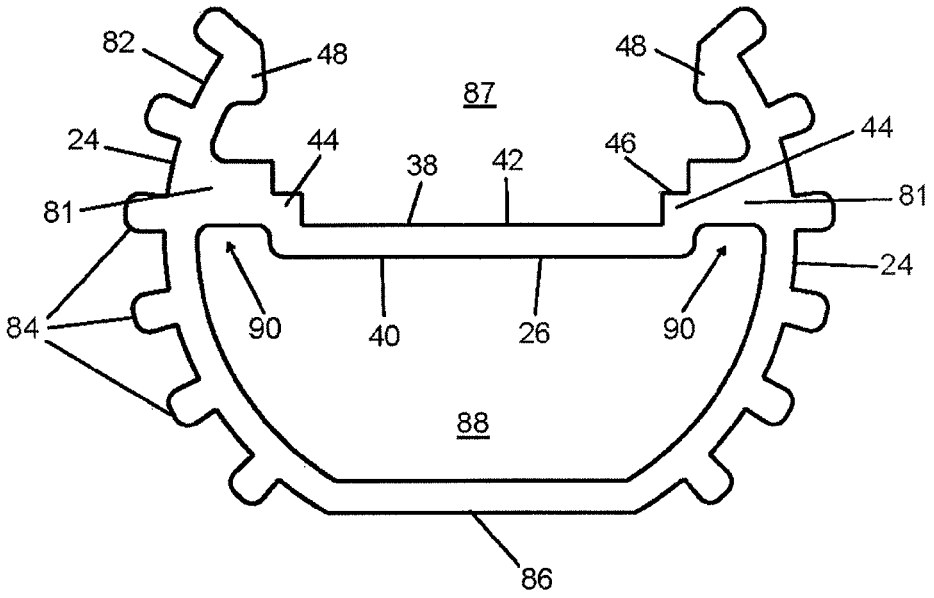
Figure 3C:
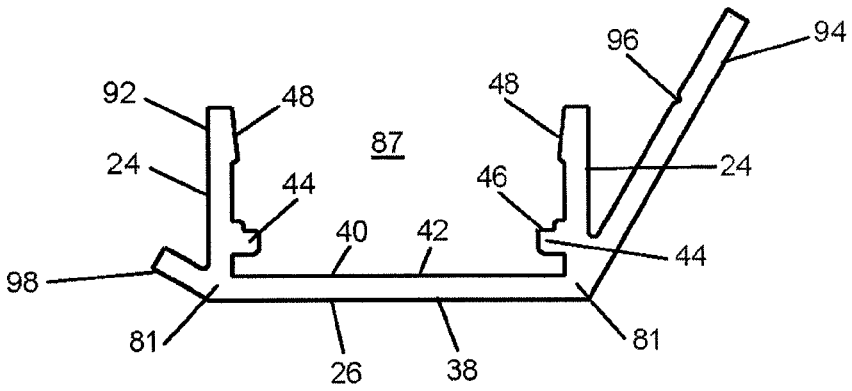

Referring to FIGS. 3A-3C, various embodiments of the extrusion 10, 74, 82, 92 are shown. These embodiments in no way comprise a complete list of possible embodiments, but instead illustrate how some different embodiments of the extrusion 10, 74, 82, 92 may be configured. For example, FIG. 3A shows an embodiment of the extrusion 74, that includes the pair of side walls 24 coupled by a connecting member 26, where the connecting member 26 is coupled to the pair of side walls 24 at a joint 81, and where the side walls 24 and connecting member 26 form a first cavity 87 and a second cavity 88. The extrusion 74 also comprises a pair of curved elements 76 which project from the surface of the pair of side walls 24 and extend away from connecting member 26 and the first and second cavities 87, 88 with a predetermined radius of curvature. In the example embodiment illustrated, these curved elements 76 extend from an area adjacent to the first end of the pair of side walls 24 to an area substantially coplanar with the second end of the pair of side walls 24. A pair of mounting plates 78 may be coupled to the pair of curved elements 76, opposite from the pair of side walls 24, and substantially coplanar to the second end of the pair of side walls 24. When mounting the lighting system against a flat surface, the pair of mounting plates 78 can rest against this flat surface and may be used to secure the lighting system to the surface by use of mounting members.

Additionally, the embodiment shown in FIG. 3A shows a bore 80 on the first surface 38 of the connecting member, through which a mounting member such as a screw or a bolt may be passed to secure the lighting system to a mounting surface. The bore 80 may pass entirely though the connecting member 26, from the first surface 38 to the second surface 40, or may extend partially into the connecting member 26, such as to provide a guide for the mounting member.

Referring to FIG. 3B, another embodiment of the extrusion 82 is shown. In this embodiment, the pair of side walls 24 are curved towards one another, with a predetermined radius of curvature on either side of the connecting member 26, so that the extrusion 82 has a substantially rounded profile. Additionally, the extrusion 82 can include a base 86 connected at or near the second ends of the pair of side walls 24 and enclosing the second cavity 88. Furthermore, the connecting member 26 may include notched portions adjacent to each of the joints 81 with the pair of side walls 24. These notched portions form subcavities 90 within the second cavity 88 which define a space in which a protrusion 168 (FIG. 8B) of an embodiment of a connector 16 may be inserted and secured by friction fit.

The flanges 44 of the extrusion 82 shown in FIG. 3A project from the side walls 24 of the extrusion 82, but are also coupled to the connecting member 26 (or integrally formed), thereby eliminating the gap which may be present in other embodiments of the extrusion 10, 74, 92. In this configuration, the flanges 44 form a second shelf 46 adapted to receive a control board 14, but also define the horizontal width of the first shelf 42, defining the position where a lighted strip 12 may be received on the first shelf 42.

The embodiment shown in FIG. 3B further comprises a plurality of bracket projections 84 arranged on the surface of the pair of side walls 24. Gripping elements 102 on a bracket 20 (FIG. 1) may be engaged or latched into the spaces between bracket projections 84 to secure the extrusion 82. The rounded pair of side walls 24, along with the plurality of bracket projections 84 allow the angle of the lighting system to be adjusted while coupled to a bracket 20, by rotating the extrusion 82 so that gripping elements 102 of the bracket 20 engage with spaces between different sets of the plurality of bracket projections 84. The light projected by the lighting system may be arranged in an arc defined substantially by the path of light between the LEDs 22 and the width of the translucent member 28 of the diffuser 16. By adjusting the angle of the extrusion lighting system as described, the possible arc of light projecting from the lighting system is thereby adjusted.

Referring to FIG. 3C, yet another embodiment of the extrusion 92 is shown. In this embodiment, the connecting member 26 is coupled to the pair of side walls 24 at joints 81 located at the second end of the side walls 24, so that the pair of side walls 24 project away from only a first side of the connecting member 26. As a result, the connecting member 26 and the pair of side walls 24 form only a first cavity 87, and do not form a second cavity 88 as described with reference to other embodiments.

For mounting purposes, the extrusion 92 can also include a mounting plate 94 projecting away from a surface of the connecting member 26 at a predetermined angle with respect to the surface of one of the pair of side walls 24. This mounting plate 94 may be secured to a mounting surface with a mounting member, or fastener, such as a screw or a bolt coupled with the mounting plate, such as by a bore 96 through the mounting plate 94. In this way, the lighting system may be mounted on a mounting surface to direct an arc of light centered at a different angle than perpendicular to the mounting surface. On the opposite side of the connecting member 26 from the mounting plate 94, an angled arm 98 may project from the surface of the other of the pair of side walls 24. The angled arm 98, may be positioned at a predetermined complementary angle from the mounted plate 94 so that the angle between the angled arm 98 to the mounting plate 94 is approximately 90 degrees. This angled arm 98 allows the lighting system to be positioned more securely in a corner of a mounting surface that has surfaces at right angles. In a mounting surface with corners having surfaces at angles greater or less than 90 degrees, it may be desirable that the angled arm 98 be set at a predetermined angle wherein the angle between the angled arm 98 and the mounting plate 94 is substantially equal to the angle of the surfaces of the corner of the mounting surface.

Figure 4A:
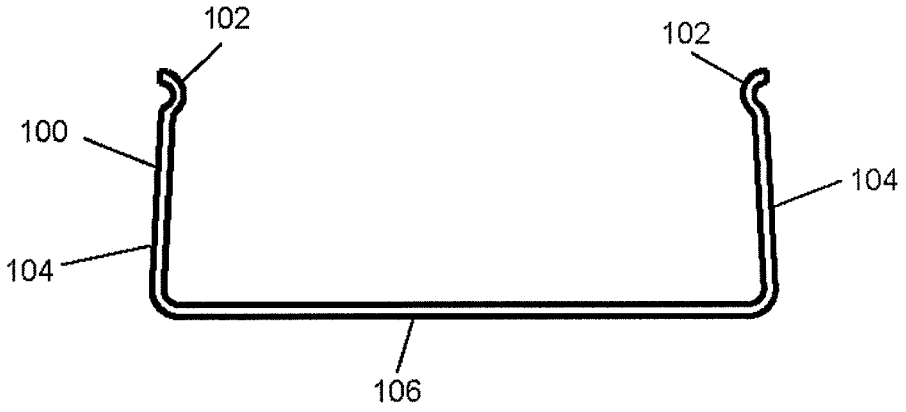
FIGS. 4A and 4B are side plan views of brackets, showing two possible examples of embodiments thereof.

Referring to FIG. 4A, an example of a squared mounting bracket 100 is shown. The squared mounting bracket 100 comprises a pair of bracket walls 104 extending from a base 106 to form a portion of a square. In other examples, bracket walls 104 and the base 106 may form a part of a rectangle, a rhombus, a triangle, or any other shape. On an opposite end of the pair of bracket walls 104 from the base 106 are gripping elements 102, which, in this embodiment, form a pair of shoulders that are curved towards a central axis of the squared mounting bracket 100. These gripping elements 102 are adapted to be received into slots 50 on the side walls 24 of various embodiments of the extrusion 10, 74 to couple the lighting system to the squared mounting bracket 100. The base 106 may also include a feature or location to accommodate coupling of the squared mounting bracket to a mounting surface. In an embodiment, the feature may be an opening (not shown) through which mounting member, or fastener, such as a screw or a bolt may pass through to secure the squared mounting bracket 100 to a mounting surface. In this way, the lighting system may be secured to the surface as the extrusion 10, 74 is coupled to the squared mounting bracket 100 and the squared mounting bracket 100 is secured to the mounting surface. When the squared mounting bracket 100 is coupled to the extrusion 10, 74, it may be desirable to have a gap between the base 106 and the extrusion 10, 74, to ensure that a portion of the mounting member extending above the base 106, such as the head of a fastener, does not interfere with the connection between the extrusion 10, 74 and the squared mounting bracket 100. The size of the gap that is formed may be based on the extent to which a length of the bracket walls 104 exceeds the distance between the slots 50 of the extrusion 10, 74 and the second end of the side walls 24 of the extrusion 10, 74.

Figure 4B:
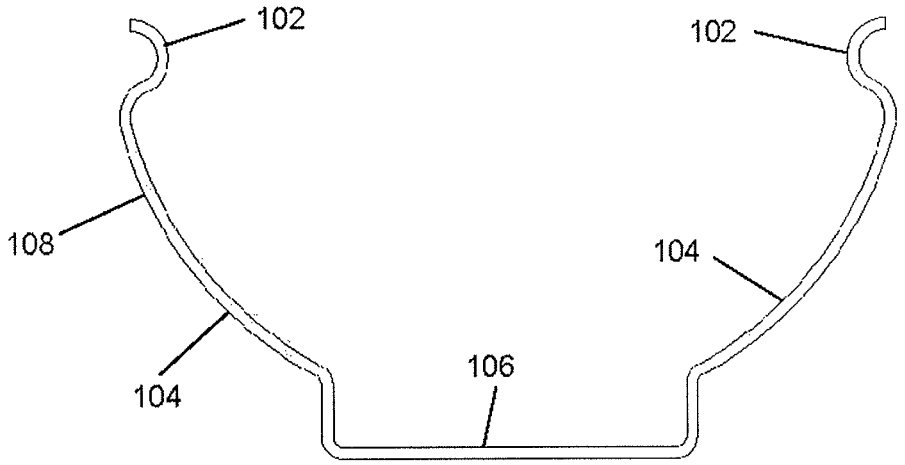

Referring to FIG. 4B, an example of a rounded mounting bracket 108 is shown, that includes a base 106, and a pair of curved bracket walls 104 extending from the base 106. Similar to the embodiment shown in FIG. 4A, this embodiment includes a pair of gripping elements 102 formed near an end of the curved bracket walls 104 opposite from the base 106. However, the rounded shape of the rounded mounting bracket 108 is intended so that the gripping elements 102 engage the spaces between bracket projections 84 of a rounded extrusion 82 shown in FIG. 3B. In this way, the rounded mounting bracket 108 may be mounted to a mounting surface, and the angle of the lighting system relative to the mounting surface may be adjusted by rotating the extrusion 82 so that the gripping elements 102 engage with different spaces between bracket projections 84.

Figure 5:
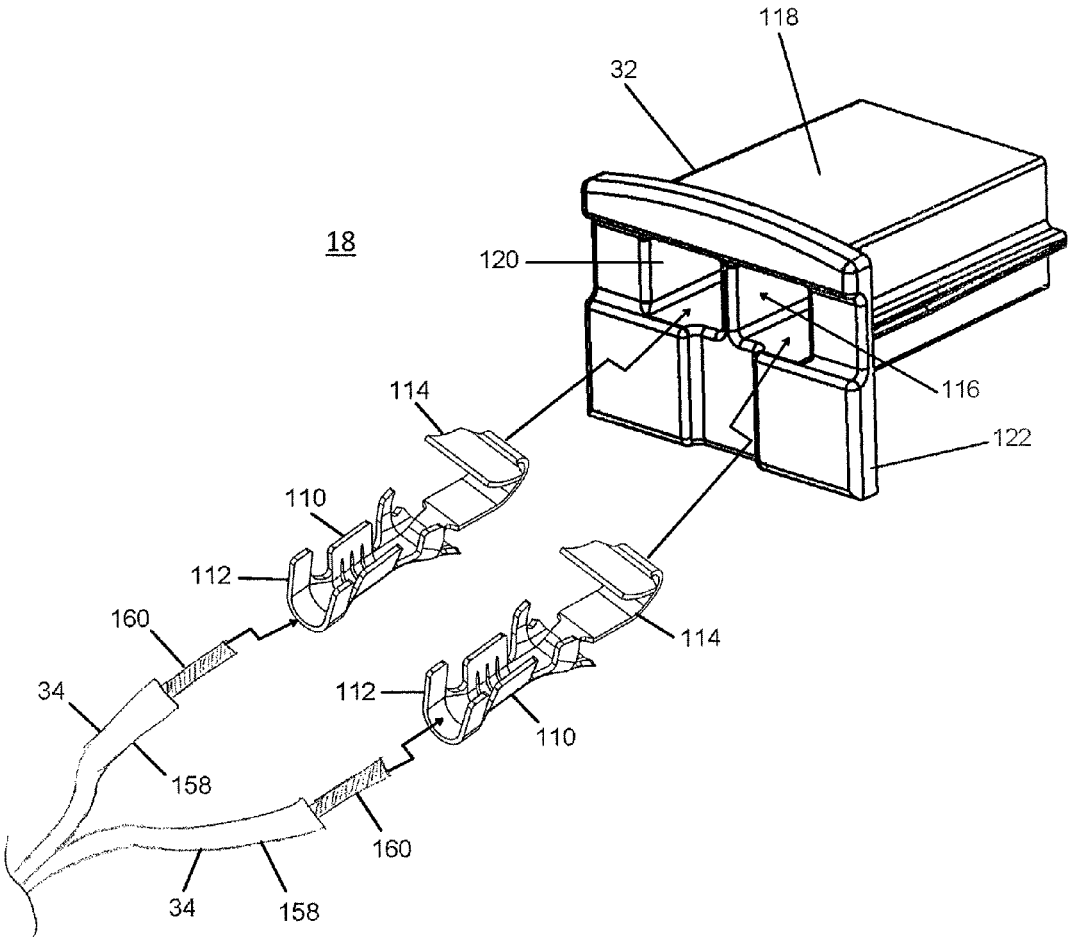
FIG. 5 is an exploded view of an example of a connector, showing a shell, a plurality of pins, and electrical wires.

Referring to FIG. 5, an exploded view of an example of a connector 18 is shown that includes a shell 32, a plurality of pins 110, and a plurality of electrical wires 34. The pins 110 are inserted into an opening 116 within the shell 32 and the exposed portion 160 of each of the wires 34 are coupled to a portion of each of the pins 110. The connector 18 is adapted to be inserted into an extrusion 10 and the pins 110 are adapted to receive and secure a lighted strip 12 within the extrusion 10.

Referring to FIGS. 5 and 6A-6D, several views of an example of a shell 32 are shown. The shell 32 comprises an outer surface 118 and an inner surface 120. The outer surface 118 includes a pair of slats 124 projecting outward from the outer surface 118 and configured to fit into the first cavity 87 of an embodiment of an extrusion 10. The slats 124 may be tapered so that the connector 18 may be securely coupled to the extrusion 10 by friction fit. In other example, any other form of locking mechanism may be used to hold the shell 82 against the extrusion. The inner surface 120 defines an opening 116 extending between a first end of the shell 32 and a second end of the shell 32.

The shell may also include a lip 122 arranged at or near the first end of the shell 32 projecting outwardly from the outer surface 118 of the shell 32. The lip 122 includes a perimeter 132 which extends about the edge of the lip 122. The perimeter 132 may be arranged so that it substantially covers the profile of the extrusion 10 when the connector 18 is coupled to the extrusion 10.

The lip 122 may also include wire channels 128, 130 as grooves in the surface of the lip 122 opposite from the shell 32. The wire channels 128, 130 may be used to direct the wires 34 in narrow spaces, where the surface of the lip 122 is adjacent to a wall or surface. The wire channel 130 may extend from the opening 128 to the perimeter 132 of the lip and is adapted to receive the plurality of wires 34 protruding from the first end of the shell 32. The wire channel 128 may extend across the opening 128 and to the perimeter 132 on one or both sides of the lip 122 to receive one or a plurality of wires 34 protruding from the first end of the shell 32.

The lip 122 may further include one or more protrusions 134 extending from the same surface of the lip 122 as the shell 32. The protrusion 134 is adapted to be received into the second cavity 88 of an extrusion 10 and may secure the connector 18 to the extrusion 10 by friction fitting.

The shell 32 may further include a tooth 126 positioned within the opening 116 of the shell 32, to separate and isolate each of the plurality of pins 110 from each other. Additionally, the tooth 126 may include an angled portion 136 adjacent to the second end of the shell 32, where the first, shorter end of the angled portion 136 is closer to the second end of the shell 32 than the second, larger end of the angled portion 136. The angled portion 136 should be adapted to direct a lighted strip 12 inserted into the opening 116 towards one portion of the inner surface 120 instead of the other. Accordingly, a lighted strip 12 inserted into the second end of the shell 32 is guided into contact with the pins 110 by the tooth 126 In addition, an inserted lighted strip 12 inserted into the second end may be held by friction fit in the connector 18 by the angled portion 136 of the tooth 126.

Figure 6A:
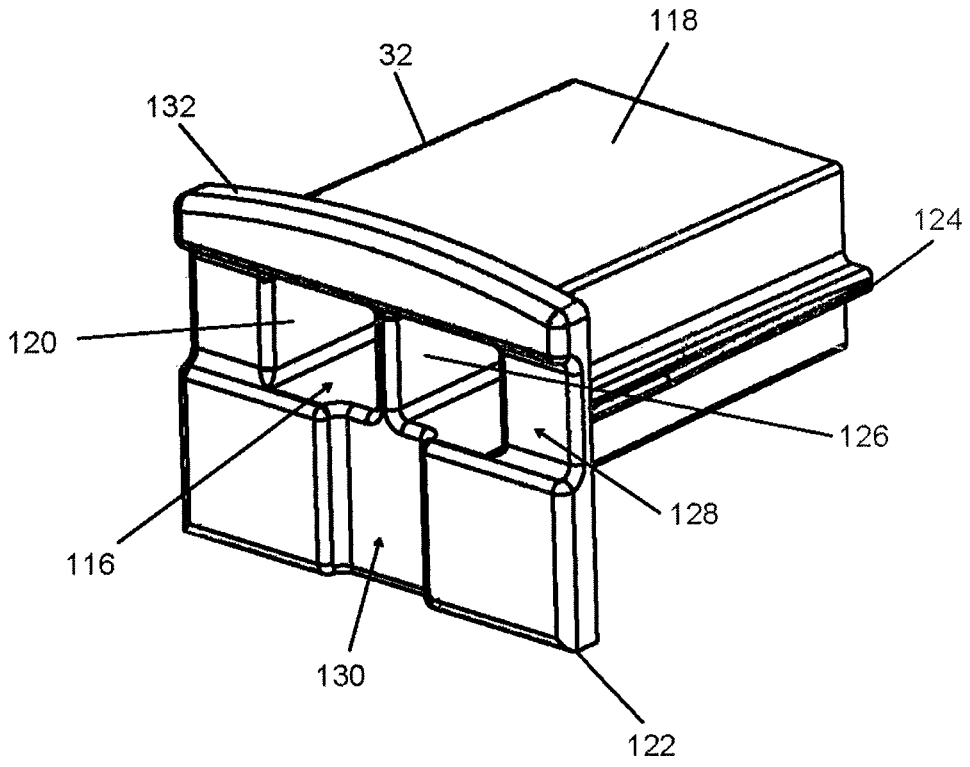
FIG. 6A is a orthographic projection of an example of a shell for a connector.
Figure 6B:
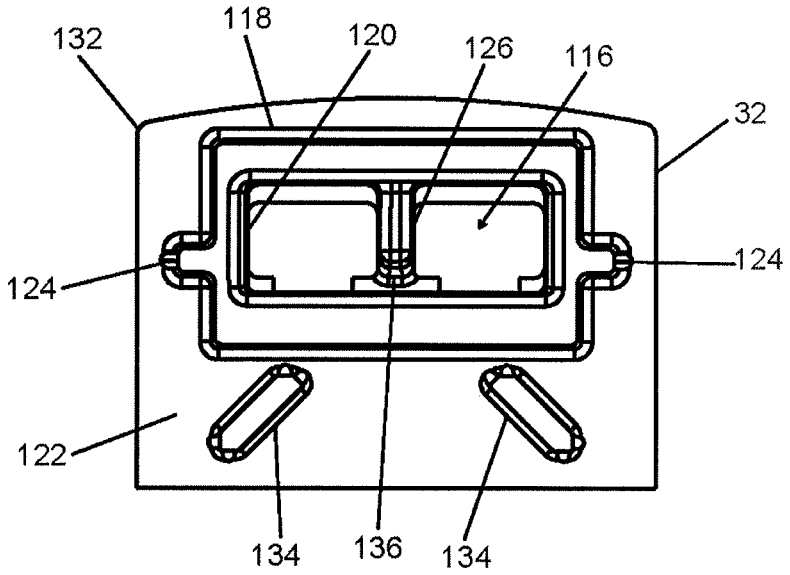
FIG. 6B is a rear plan view of an example of a shell for a connector.
Figure 6C:
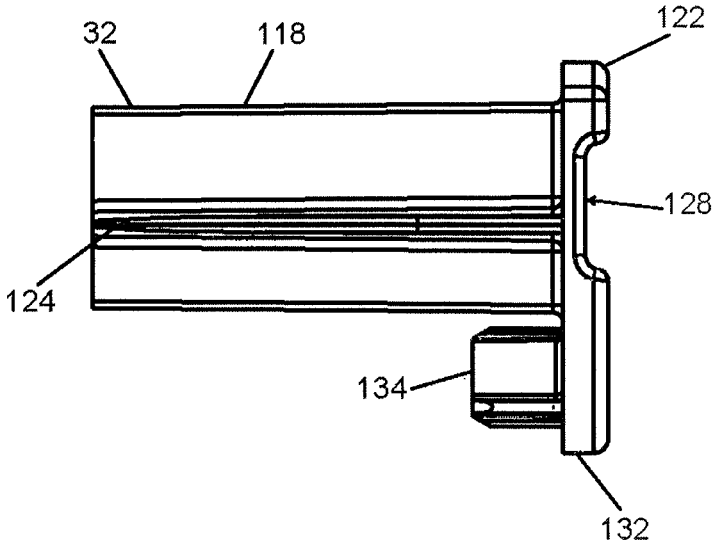
FIG. 6C is a side plan view of an example of a shell for a connector.
Figure 6D:
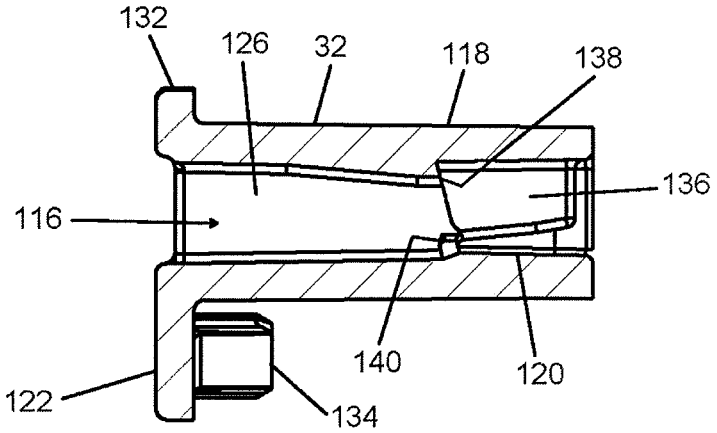
FIG. 6D is a side cross-sectional view of an example of a shell for a connector.

Referring to FIG. 6D, a cross-sectional view of an example of the shell 32 is shown illustrating that the inner surface 120 of the shell 32 may also comprise a first ridge 138 and a second ridge 140 within the opening 116 of the shell 32. The first ridge 138 is arranged on a first portion of the inner surface 120, while the second ridge 140 is arranged on a second portion of the inner surface 120 opposite from the first portion of the inner surface 120. Both the first and second ridges 138, 140 may include of single projections from the inner surface 120, or a plurality of projections from the inner surface 120. Each of the first and second ridges 138, 140 may take the form of a face which defines a break in the inner surface 120 of the shell 32. The face of the first ridge 138 is arranged towards the second end of the shell 32, and the face of the second ridge 140 is arranges toward the first end of the shell 32.

Figure 7A:
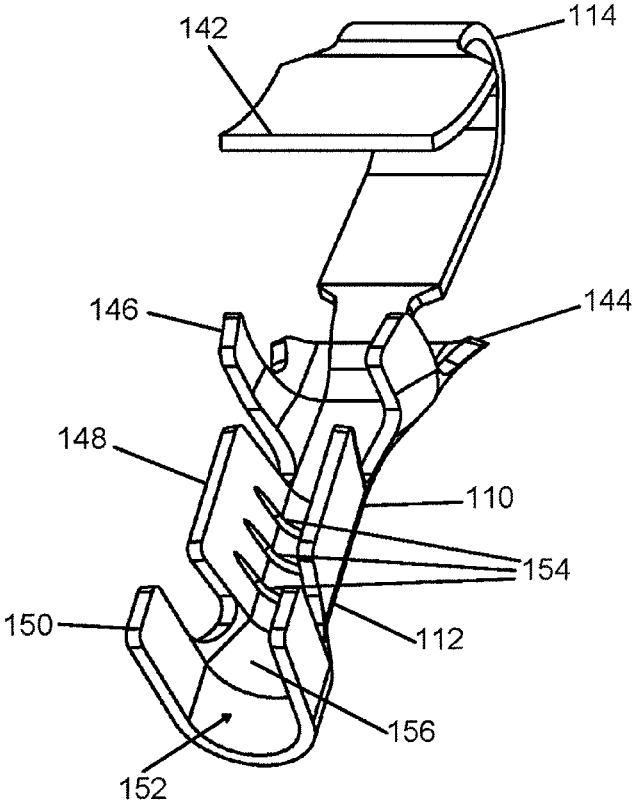
FIG. 7A is a orthographic projection of an example of a pin for a connector.
Figure 7B:
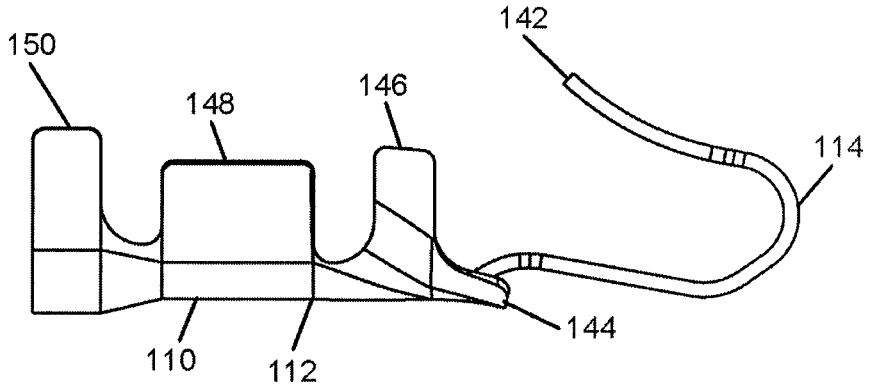
FIG. 7B is a side plan view of an example of a pin for a connector.
Figure 7C:
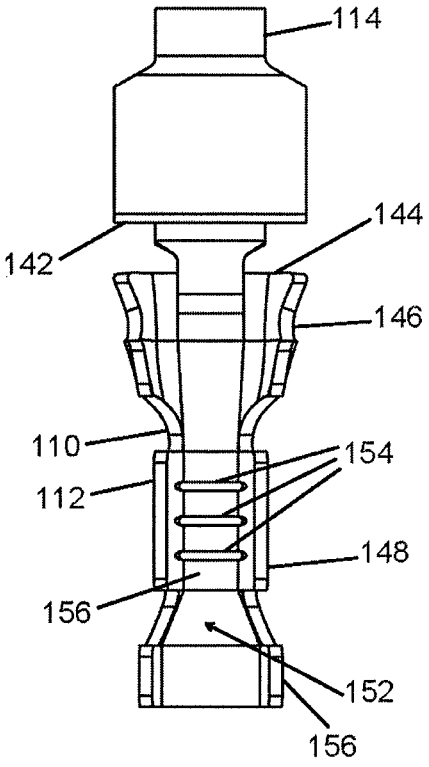
FIG. 7C is a top plan view of an example of a pin for a connector.

Referring to FIGS. 7A-7C, several views of an example of a pin 110 are shown. The pin 110 comprises a female portion 112 adapted to receive a wire 34, a curved contact plate 114 adapted to contact and secure a lighted strip 12 adjacent to the second end of the shell 32, a foot 144 adapted to rest against the second ridge 140 of the inner surface 120 of the shell 32, and a stop 142 adapted to rest against the first ridge 138 of the inner surface of the shell 32.

The female portion 112 of the pin 110 is curved to define a trough 152 adapted to receive the exposed portion 160 of a wire. The female portion 112 may have one or more crimping elements 148 coupled to the trough 152 and arranged to be bent by a compressive force to forcibly couple the wire 34 to the contacting surface 156 of the trough 152 and create an electrical connection between the wire 34 and the pin 110. To further facilitate a secure electrical connection, the contacting surface 156 of the trough 152 may also include one or more blades 154 which project from the contacting surface 156. When the crimping elements 148 have compressed the wire 34, the blades 154 provided direct force to specific points of the wire 34 to further secure the electrical connection. A second set of crimping elements (not shown) may be included which may be bent by a compressive force to forcibly couple the insulated portion 158 of the wire 34 to the connector and fix the position of the wire 34 with respect to the pin 110.

The female portion 112 of the pin 110 may also comprise a plurality of positioning elements 146, 150 extending from the trough 152 to secure the vertical position of the pin 110 within the shell 32. The trough 152 rests on a first portion of the inner surface 120, while the positioning elements 146, 150, extend from the trough 152 to contact a second portion of the inner surface 120 which is opposite from the first portion. Positioning members 146, 150 may vary in size depending on their intended placement within the shell 32. For example, positioning elements 150 adjacent to the first end of the shell 32 may have a different size from positioning elements 146 further from the first end of the shell 32, as the opening 116 varies in size from the first end to the second end of the shell 32.

The curved contact plate 114 of the pin 110 is adapted to be positioned adjacent to the second end of the shell 32, and is curved outwardly towards the second end. The curved contact plate 114 is configured to exert an expansive force on the inner surface 120 of the shell 32 so that, when a lighted strip 12 is inserted into the opening 116 of the connector 18, electrical contacts 36 on the lighted strip 12 will slide under the curved contact plate 114 and be compressively secured between the inner surface 120 of the shell 32 and the curved contact plate 114. The contact elements 36 of the lighted strip 12 are arranged to contact the curved contact plate 114 instead of the inner surface 120 due to the side walls 24, etc.

The foot 144 of the pin 110 may be arranged to project outward from the pin 110 and include a surface facing the second ridge 140. In this way, the surface of the foot 144 will rest against the second ridge 140 and prevent movement of the pin 110 in one direction. In the embodiment shown, the foot 144 projects outward from the pin 110 as an edge arranged between the female portion 112 and the curved contact plate 114.

The stop 142 of the pin 110 may be arranged to project outward from the pin 110, and have a surface which faces the first ridge 138. In this way, the surface of the stop 142 rests against the first ridge 138 and prevents movement of the pin 110 in the opposite direction of the one direction of movement prevented by the foot 144. Thus the cooperative operation of the second ridge 140 and the first ridge 138 securely and fixedly positions the pin 110 within the shell 32. In addition, when slidably mounted in the shell 32, the pin 110 is locked in place and arrested from further sliding upon contacting the second ridge 140 and the first ridge 138. In the embodiment shown, the stop 142 takes the form of a surface at the end of the curved contact plate 114. The curved contact plate 114 curves toward and eventually rests in the first ridge 138. One advantage of such an embodiment is that if the pin 110 must be removed from the shell 32, the curved contact plate 114 can be compress to unseat the stop 142 from the first ridge 138 so that the pin 110 may be extracted from the first end of the shell 32. The stop 142 and the foot 144 may project outward from the pin 110 in the same direction, or in opposite directions on either side of the pin 110.

Figure 8A:
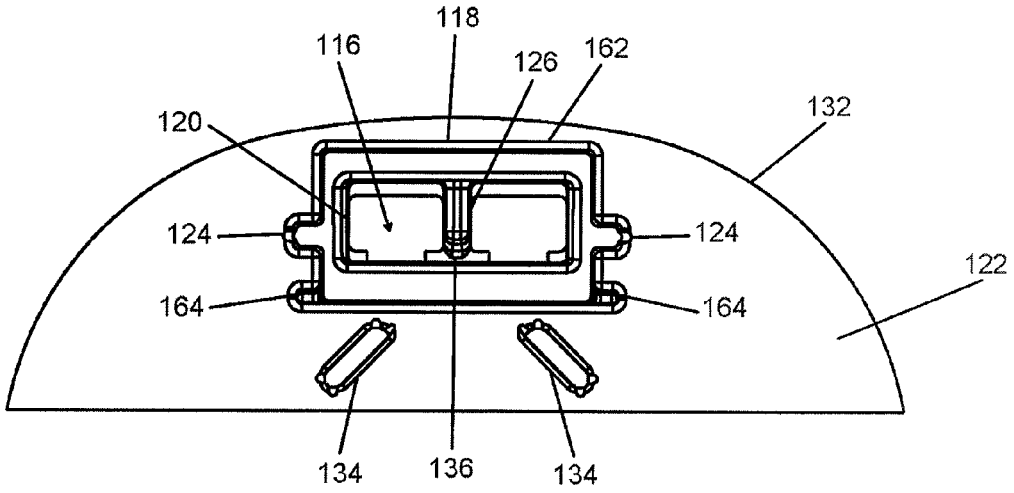
FIGS. 8A-8C are rear plan views of shells for a connector, showing three possible examples of embodiments thereof.
Figure 8B:
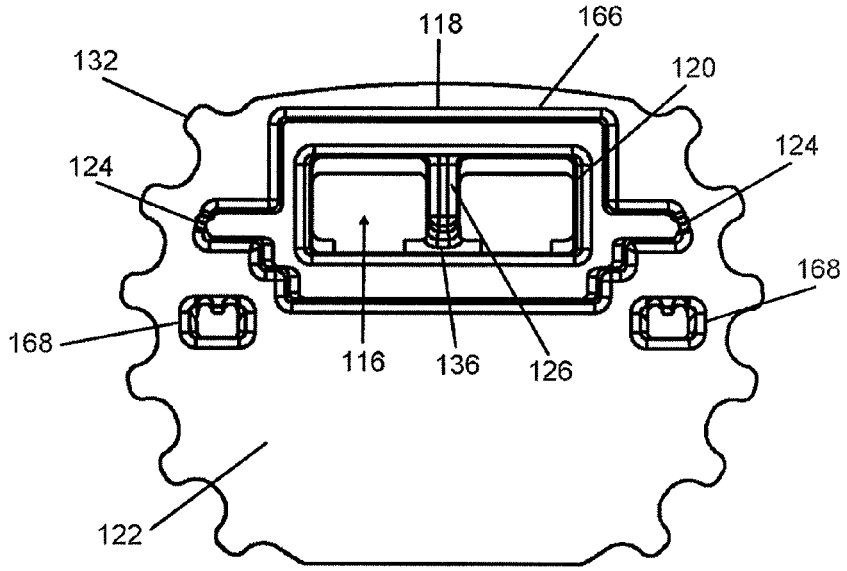
Figure 8C:
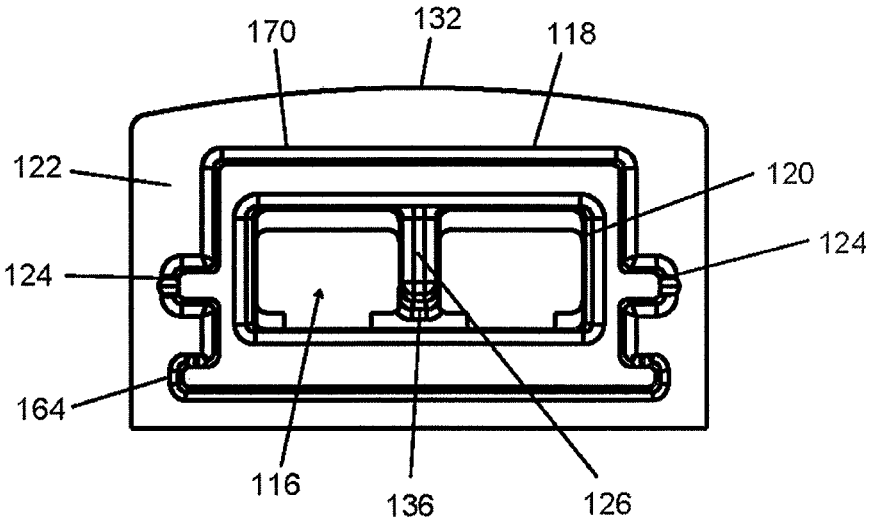

Referring to FIGS. 8A-8C, various embodiments of the shell 32, 162, 166, 170 are shown. The shell 32 is adapted to be inserted into the extrusion 10. For example, the shell 32 shown in FIGS. 6A-6D is adapted to be inserted into the extrusion 10 shown in FIG. 2, with slats 124, protrusions 134, and a perimeter 132 which are all specific to that embodiment of the extrusion 10.

Similarly, the shell 162 shown in FIG. 8A is adapted to be inserted into the extrusion 74 shown in FIG. 3A, with a curved perimeter 132 covering the profile of the extrusion 74 and a second pair of slats 164 which are configured to be friction fitted into the gap of the extrusion 74 between the first shelf 42 and the projections 44 from the pair of side walls 24.

The shell 166 shown in FIG. 8B is adapted to be inserted into the extrusion 82 shown in FIG. 3B, with a rounded perimeter 12 which substantially covers the profile of the extrusion 82 and a pair of protrusions 168 adapted to be friction fitted into the subcavities 90 of the second cavity 88.

The shell 170 shown in FIG. 8C is adapted to be inserted into the extrusion 92 shown in FIG. 3C, with a perimeter which substantially covers the profile of the extrusion 92, excepting the angled mounting plate 94 and the angled arm 98, and having a second pair of slats 164 configured to be friction fitted into the extrusion 74 between the first shelf 42 and the projections 44 from the side walls 24. Insertion of the shell 32 into the extrusion 92, and coupling therebetween is not limited to the examples described herein.

Figure 9:
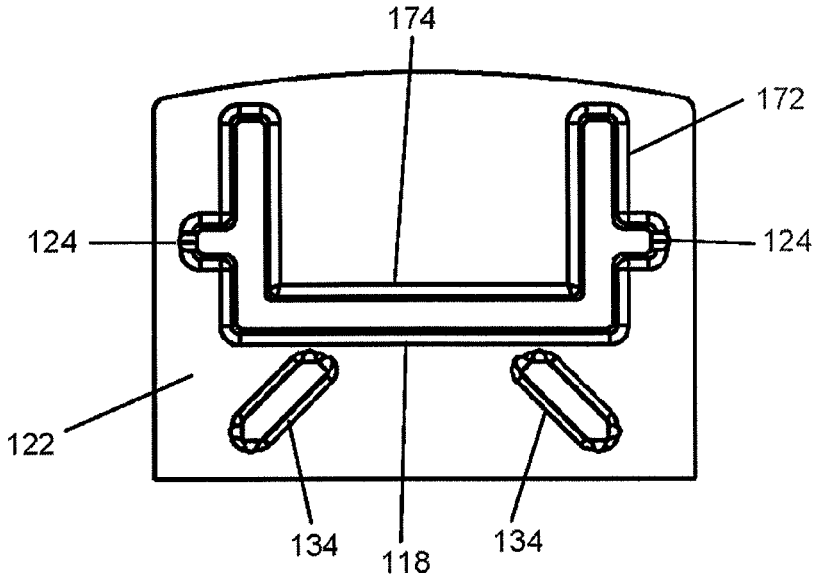
FIG. 9 is a rear plan view of an example of an end cap.

Referring to FIG. 9, an example of an end cap 172 is shown which may be inserted into the extrusion 10 on an end of the extrusion 10 which does not require electrical connection. The end cap 172 comprises shell 174, and a pair of slats 124 projecting from the outer surface 118 of the shell 174 and adapted to be friction fitted into the extrusion 10. The end cap 172 may also comprise a lip 122 projecting outward from the end of the end cap 172, which substantially overlaps with the profile of the extrusion 10. The end cap 172 may further comprise a protrusion 134 projecting from the lip 122, which is adapted to be received within the second cavity 88 of an extrusion 10.

Accordingly, it is now apparent that there are many advantages of the invention provided herein. In addition to the advantages that have been described, it is also possible that there are still other advantages that are not currently recognized but which may become apparent at a later time.

While preferred embodiments of the invention have been described, it should be understood that the invention is not so limited, and modifications may be made without departing from the invention. The scope of the invention is defined by the appended claims, and all devices that come within the meaning of the claims, either literally or by equivalence, are intended to embrace them.

We claim:

1. A lighting system, comprising:

a shell comprising an outer surface and an inner surface, the outer surface comprising a plurality of slats projecting outwardly from the outer surface, the outer surface and the slats adapted to be at least partially inserted into an extrusion, the inner surface comprising a first ridge projecting inwardly from the inner surface and a second ridge projecting inwardly from the inner surface, wherein the inner surface defines an opening; and a plurality of pins arranged within the opening, wherein each pin is adapted to receive a wire, each of the plurality of pins comprising a curved contact plate adapted to contact a lighted strip, a foot which rests against the second ridge of the inner surface of the shell, and a stop which rests against the first ridge of the inner surface of the shell.

2. The lighting system of claim 1, wherein the pin further comprises a trough which rests on a first portion of the inner surface of the shell, and a positioning element extending from the trough which contacts a second portion of the inner surface of the shell opposite the first portion of the inner surface.

3. The lighting system of claim 2, wherein the pin further comprises a pair of crimping elements which are coupled to the trough and arranged to couple the wire to a contacting surface of the trough.

4. The lighting system of claim 2, wherein the trough comprises a blade coupled to a contacting surface of the trough.

5. The lighting system of claim 1, further comprising a lip arranged on a first end of the shell, the lip projecting outwardly from the outer surface.

6. The lighting system of claim 5 wherein the lip further comprises a protrusion extending from a surface of the lip, wherein the protrusion is adapted to be received within the extrusion.

7. The lighting system of claim 1, wherein the shell further comprises a tooth positioned within the opening of the shell to separate each of the plurality of pins from each other.

8. The lighting system of claim 7, wherein the tooth has an angled portion and a first end of the angled portion is closer to a second end of the shell than a second end of the angled portion.

9. A lighting system, comprising:

a connector for use in a lighting system, the connector comprising a shell comprising an outer surface and an inner surface, the outer surface being configured to engage with an extrusion containing an LED lighted strip, wherein the inner surface and the outer surface define an opening in the shell; and a plurality of pins arranged within the opening, each pin comprising a contact plate configured to exert an expansive force against the inner surface of the shell such that an electrical contact of the LED lighted strip inserted into the opening is compressively secured between the contact plate and the inner surface of the shell.

10. A lighting system, comprising:

a shell comprising an outer surface and an inner surface, the outer surface comprising a plurality of slats having a taper from a first end to a second end and projecting outwardly from the outer surface, the outer surface and the slats adapted to be at least partially inserted into an extrusion, the inner surface comprising a first ridge and a second ridge, wherein the inner surface defines an opening; and a plurality of pins arranged within the opening, wherein each pin is adapted to receive a wire, each of the plurality of pins comprising a curved contact plate adapted to contact a lighted strip, a foot which rests against the second ridge of the inner surface of the shell, and a stop which rests against the first ridge of the inner surface of the shell.

11. The lighting system of claim 10, wherein the shell has a first side and a second side opposed from the first side, and wherein the plurality of slats comprises a first pair of slats projecting from the outer surface of the shell respectively on the first side and the second side.

12. The lighting system of claim 11, wherein the shell has a bottom and a top, and wherein the plurality of slats further comprises a second pair of slats projecting from the outer surface of the shell respectively on the first side and the second side, wherein the second pair of slats is arranged closer to the bottom of the shell than the first pair of slats.

13. The lighting system of claim 12, wherein the second pair of slats is located at the bottom of the shell.

14. The lighting system of claim 10, wherein the shell is adapted to receives a wire at a front of the shell, wherein the inner surface of the shell comprises a top and a bottom, wherein the shell further comprises a tooth positioned within the opening of the shell to separate each of the plurality of pins from each other, and wherein the tooth is coupled to the bottom of the inner surface at a location which is closer to the front of the shell than a location where the tooth is coupled to the top of the inner surface.

15. The lighting system of claim 14, wherein the tooth comprises a vertical portion extending downward from the top of the inner surface and an angled portion extending from the vertical portion toward the front of the shell and the bottom of the inner surface.

16. The lighting system of claim 15, wherein a slot is defined between the angled portion of the tooth and the bottom of the inner surface, the slot being configured to receive an LED lighted strip.

17. The lighting system of claim 16, wherein the slot is configured to retain an LED lighted strip by friction fitting.

* * * * *